US011548295B2

(12) United States Patent
Komine et al.

(10) Patent No.: US 11,548,295 B2
(45) Date of Patent: Jan. 10, 2023

(54) IMAGE FORMING APPARATUS

(71) Applicants: Yusuke Komine, Kanagawa (JP); Toshiya Satoh, Kanagawa (JP); Teiichiro Ishikawa, Tokyo (JP); Masaya Hamaguchi, Kanagawa (JP); HuiZee Then, Kanagawa (JP); Naohiro Toda, Kanagawa (JP); Hidehisa Shibasaki, Ibaraki (JP)

(72) Inventors: Yusuke Komine, Kanagawa (JP); Toshiya Satoh, Kanagawa (JP); Teiichiro Ishikawa, Tokyo (JP); Masaya Hamaguchi, Kanagawa (JP); HuiZee Then, Kanagawa (JP); Naohiro Toda, Kanagawa (JP); Hidehisa Shibasaki, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/468,680

(22) Filed: Sep. 8, 2021

(65) Prior Publication Data

US 2022/0126602 A1 Apr. 28, 2022

(30) Foreign Application Priority Data

Oct. 23, 2020 (JP) ..... JP2020-178078

(51) Int. Cl.
*B41J 11/00* (2006.01)

(52) U.S. Cl.
CPC ..... *B41J 11/0021* (2021.01); *B41J 11/0022* (2021.01); *B41J 11/0085* (2013.01)

(58) Field of Classification Search
CPC . B41J 11/0021; B41J 11/0022; B41J 11/0085; B41J 11/00216; B41J 11/0024
See application file for complete search history.

(56) References Cited

U.S. PATENT DOCUMENTS

| | | | | |
|---|---|---|---|---|
| 2019/0283459 | A1 | 9/2019 | Nakamura et al. | |
| 2019/0299692 | A1* | 10/2019 | Toda ..... | C09D 11/40 |
| 2020/0276839 | A1 | 9/2020 | Satoh et al. | |

FOREIGN PATENT DOCUMENTS

| | | |
|---|---|---|
| JP | 10-175338 | 6/1998 |
| JP | 2004-255720 | 9/2004 |
| JP | 2011-051215 | 3/2011 |
| JP | 2012-020548 | 2/2012 |
| JP | 2017-226491 | 12/2017 |
| JP | 2020-082703 | 6/2020 |

* cited by examiner

*Primary Examiner* — Bradley W Thies
(74) *Attorney, Agent, or Firm* — Xsensus LLP

(57) ABSTRACT

An image forming apparatus includes an image forming device, a rotatable conveying member, and a suction device. The image forming device forms an image on a continuous recording medium. The conveying member has a hollow drum shape. The conveying member conveys the continuous recording medium. The suction device is disposed inside the hollow drum shape of the conveying member. The suction device sucks the continuous recording medium through the conveying member in a fixed region in which the continuous recording medium and the conveying member are in contact with each other.

9 Claims, 3 Drawing Sheets

IMAGE FORMING APPARATUS

CROSS-REFERENCE TO RELATED APPLICATIONS

This patent application is based on and claims priority pursuant to 35 U.S.C. § 119(a) to Japanese Patent Application No. 2020-178078, filed on Oct. 23, 2020, in the Japan Patent Office, the entire disclosure of which is incorporated by reference herein.

BACKGROUND

Technical Field

Embodiments of the present disclosure relate to an image forming apparatus.

Related Art

Inkjet image forming apparatuses are known to form images by fixing a recording medium such as a sheet to a conveyance drum and by discharging ink toward the recording medium, from a recording head disposed close to an outer circumferential surface of the conveyance drum. Such inkjet image forming apparatuses are required to achieve both high productivity and a reduction in damage to the recording medium during drying.

Warm air or an infrared heater is used to dry an image on a recording medium; however, the recording medium is damaged during drying. On the other hand, damage to the recording medium during drying is reduced by using a temperature-adjustable conveyance drum and winding the recording medium around the conveyance drum.

SUMMARY

Embodiments of the present disclosure described herein provide a novel image forming apparatus including an image forming device, a rotatable conveying member, and a suction device. The image forming device forms an image on a continuous recording medium. The conveying member has a hollow drum shape. The conveying member conveys the continuous recording medium. The suction device is disposed inside the hollow drum shape of the conveying member. The suction device sucks the continuous recording medium through the conveying member in a fixed region in which the continuous recording medium and the conveying member are in contact with each other.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
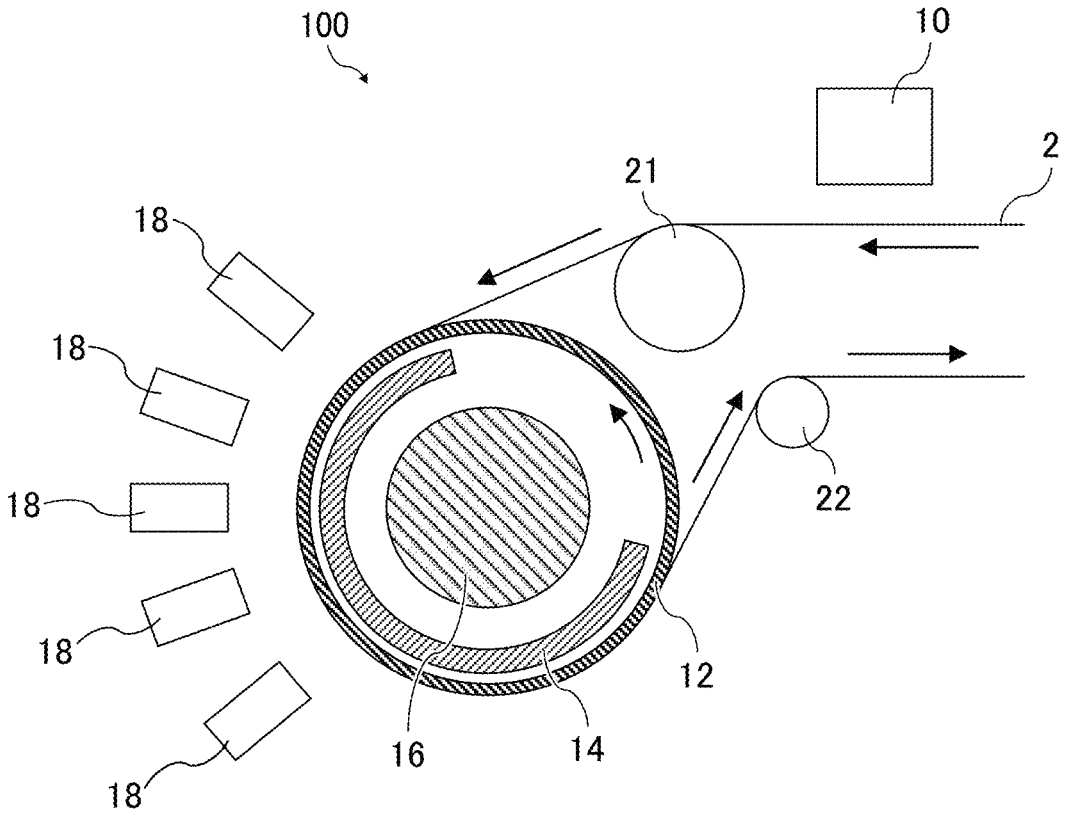
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

Descriptions are given of an example applicable to an image forming apparatus. Note that the following embodiments are not limiting the present disclosure and any deletion, addition, modification, change, etc. can be made within a scope in which person skilled in the art can conceive including other embodiments, and any of which is included within the scope of the present disclosure as long as the effect and feature of the present disclosure are demonstrated.

The image forming apparatus according to the present disclosure includes an image forming device, a rotatable hollow drum-shaped conveying member configured to convey a continuous recording medium, and a suction device disposed inside the conveying member and configured to suck the recording medium through the conveying member. The region to be suctioned by the suction device is a fixed region where the recording medium and the conveying member come into contact with each other.

Figure 2:
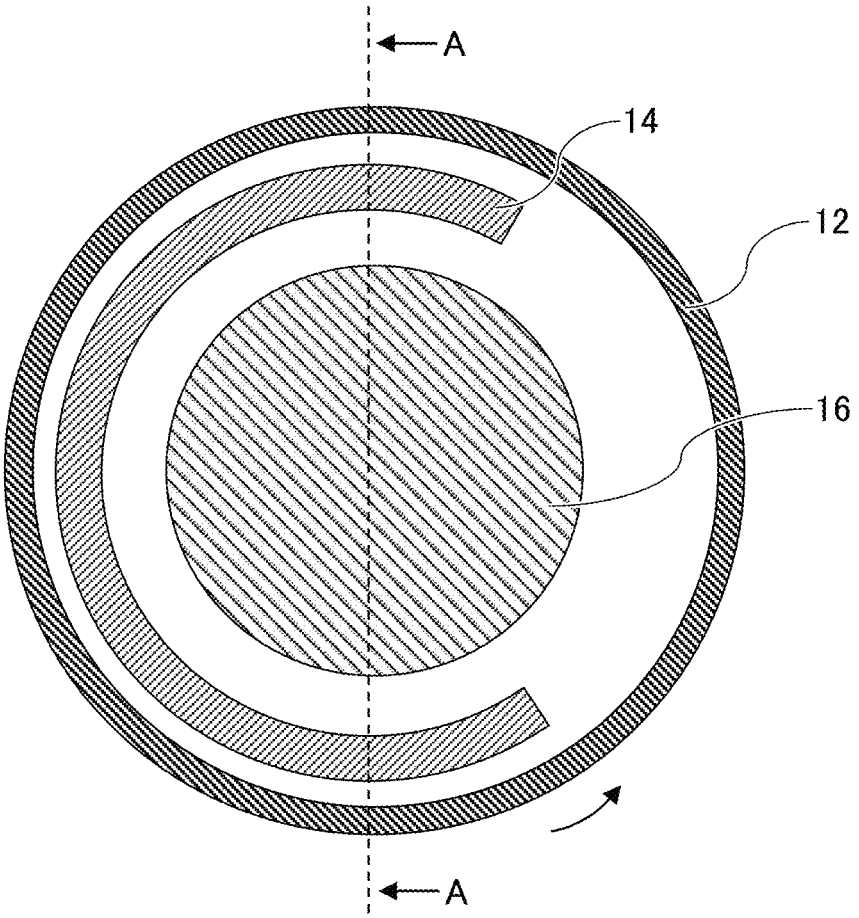
FIG. 2 is a diagram illustrating a schematic configuration of a main part of the image forming apparatus according to an embodiment of the present disclosure.
Figure 3:
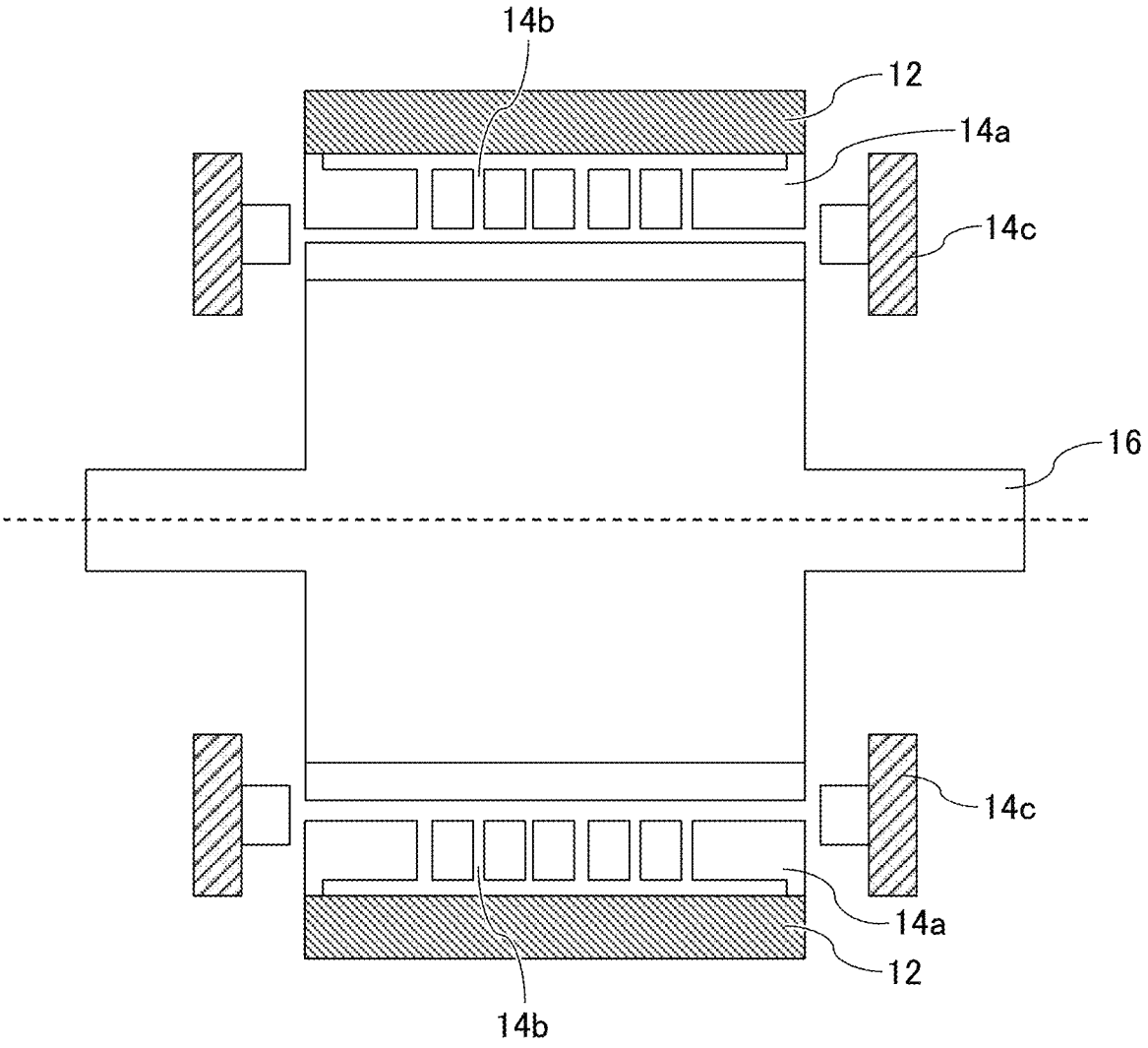
FIG. 3 is a schematic cross-sectional view of the main part of FIG. 2.

A description is given of the image forming apparatus according to an embodiment of the present disclosure, with reference to FIGS. 1 to 3.

FIG. 1 is an overall schematic view of an image forming apparatus 100 according to the present embodiment.

FIG. 2 is a schematic cross-sectional view of a main part of the image forming apparatus 100 of FIG. 1.

FIG. 3 is an A-A cross-sectional view of the main part of FIG. 2.

FIG. 1 illustrates a recording medium 2, an image forming device 10, a conveying member 12, a suction device 14, a heating device 16, drying devices 18, and conveyance rollers 21 and 22.

The recording medium 2 is conveyed by the conveyance rollers 21 and 22 and the conveying member 12 in the direction indicated by arrows in FIG. 1. The recording medium 2 is a continuous recording medium and is referred to as a base material or a continuous sheet. The material of the recording medium 2 is appropriately changed. For example, paper, thread, fiber, fabric, leather, metal, plastic, glass, wood, or ceramic may be used.

The image forming device 10 may be, for example, an inkjet head (also referred to as a recording head). The image forming device 10 according to the present embodiment is disposed upstream from a region in which the conveying member 12 and the recording medium 2 are in contact with each other in the conveyance direction of the recording medium 2.

The image forming device 10 forms an image by applying or discharging a recording liquid (also referred to as ink) to the surface of the recording medium 2. The ink to be used is appropriately changed and may be one type or a plurality of types.

The conveying member 12 is a rotatable hollow drum-shaped device and conveys the recording medium 2 while rotating. Hereinafter, the drum-shaped conveying member may be referred to as a conveying drum.

The conveying member 12 is appropriately selected from any device as long as the suction device 14 sucks the recording medium 2 through the conveying member 12. For example, a porous material may be used as the conveying member 12. By using a porous material, suction by the suction device 14 is facilitated, and the adhesion between the recording medium 2 and the conveying member 12 is further enhanced.

When a porous material having a plurality of holes is used, each of the plurality of holes of the porous material preferably has an appropriate size. If each of the plurality of holes, simply referred to as the hole, is too large, the recording medium 2 may follow the shape of the hole to cause damage to the recording medium 2. If the hole is too small, the resistance to suction increases, and sufficient suction force may not be obtained. From this perspective, the average hole size of the porous material is preferably 5 μm to 30 μm.

The suction device 14 is disposed inside the conveying member 12 and sucks the recording medium 2 through the conveying member 12. While the suction device 14 sucks the recording medium 2, the conveying member 12 rotates in the direction indicated by arrow in FIG. 1, thereby conveying the recording medium 2. The suction device 14 performs suction in the direction from the circumference of the conveying member 12 toward the center of the conveying member 12, thereby improving the adhesion between the recording medium 2 and the conveying member 12.

If the suction device 14 is not used, the conveying member 12 and the recording medium 2 do not have good adhesion to each other, and air enters between the conveying member 12 and the recording medium 2 to generate air bubbles. When the conveying member 12 and the recording medium 2 are in good close contact with each other, heat applied to the recording medium 2 is transferred to the conveying member 12 even if the recording medium 2 is dried by the drying devices 18, thus preventing a rapid increase in temperature of the recording medium 2. However, if the drying devices 18 dries the recording medium 2 with air entering between the conveying member 12 and the recording medium 2, heat is not transferred to the conveying member 12 in a portion where air enters (a portion where air bubbles are generated), and the temperature of the recording medium 2 rapidly increases, causing damage to the recording medium 2.

Further, since the air knife method is a method generally used to press the recording medium with air from above, it is difficult to remove air bubbles between the conveying member 12 and the recording medium 2 other than air bubbles generated at the boundary where the conveying member 12 and the recording medium 2 begin to contact with each other. In addition, when the conveying speed of the recording medium 2 is high, it is difficult to obtain the adhesion between the recording medium 2 and the conveying member 12, in other words, to closely contact the recording medium 2 and the conveying member 12, even when the air knife method is used.

In the present embodiment, the suction device 14 is disposed inside the conveying member 12 and the recording medium 2 is suctioned through conveying member 12, so that the conveying member 12 and the recording medium 2 have good adhesion to each other. Due to such a configuration, air entering between the conveying member 12 and the recording medium 2 is prevented. Even if air enters when the conveying member 12 and the recording medium 2 come into contact each other, the air entering between the conveying member 12 and the recording medium 2 is removed by using the suction device 14.

As a result, the present embodiment enhances the adhesion between the recording medium 2 and the conveying member 12, even in the case of using the drying device, and even in the case of high-speed conveyance in which air bubbles are generated with the generally used air knife method, and prevents damage to the recording medium 2.

In the present embodiment, the region where the suction device 14 performs suction is fixed to the region where the recording medium 2 and the conveying member 12 are in contact with each other. As illustrated in FIG. 1, in the present embodiment, since the suction device 14 is disposed in a part of the rotation direction of the conveying member 12, the recording medium 2 is sucked in a fixed region of the conveying member 12. According to this configuration, suction of the recording medium 2 is prevented in a region where the recording medium 2 and the conveying member 12 are not in contact with each other, and conveyance of the continuous recording medium 2 is prevented from being hindered.

On the other hand, in an image forming apparatus that employs a known technique, a suction unit rotates together with a conveying member (conveying drum). With this configuration, there are portions where the recording medium is sucked and portions where the recording medium is not sucked. Therefore, when the continuous sheet is conveyed, the suction force is not applied as the suction unit such as a suction plate rotates, and the adhesion between the conveying drum and the recording medium is not sufficiently obtained.

In the present embodiment, as described above, since the suction device 14 is disposed in a part of the rotation direction of the conveying member 12, suction of the recording medium 2 is prevented in a region where the recording medium 2 and the conveying member 12 are not in contact with each other. Thus, conveyance of the recording medium 2 is prevented from being hindered.

As another example, the suction force of the suction device 14 is changed depending on the region. In this case, the suction force applied to the region where the recording medium 2 does not come into contact with the conveying member 12 is lower than the region where the recording medium 2 comes into contact with the conveying member 12. This change of the suction force of the suction device 14 also prevents conveyance of the continuous recording medium 2 from being hindered.

The suction device 14 is appropriately selected, and is configured as illustrated in FIG. 3, for example. The suction device 14 having the configuration as illustrated in FIG. 3, for example, has a preform 14*a* and a suction unit 14*c*, which are fixedly disposed in the image forming apparatus 100. Note that the broken line in FIG. 3 represents the rotation axis of the conveying member 12.

The preform 14*a* has suction paths 14*b*, and when the suction unit 14*c* performs suction, the sucked air flows through the suction paths 14*b*. Thus, the recording medium 2 on the conveying member 12 is sucked, and the recording medium 2 adheres to the surface of the conveying member 12.

As the suction unit 14*c* is, for example, a blower. The suction unit 14*c* is fixedly disposed on a side surface of the conveying member 12, for example. In this example, the suction units 14*c* are disposed on both side surfaces of the conveying member 12. However, the present embodiment is not limited to this configuration, and the suction unit may be disposed on one side surface.

As illustrated in FIG. 3, the image forming apparatus 100 of the present embodiment includes a heating device 16 inside the conveying member 12. The heating device 16 heats the conveying member 12. The heating device 16 may directly heat the conveying member 12. Alternatively, the heating device 16 may heat the conveying member 12 via the suction device 14, for example, the preform 14*a* or the suction paths 14*b* formed in the preform 14*a*.

By using the heating device 16, the conveying member 12 is efficiently heated, and the temperature of the conveying member 12 is adjusted, for example, to keep the temperature of the conveying member 12 constant. In the case where the temperature of the conveying member 12 is kept constant, when the recording medium 2 is heated by the drying devices 18, the temperature difference between the front and back surfaces of the recording medium 2 is reduced, and damage to the recording medium 2 is reduced.

The heating device 16 is selected accordingly. For example, a hot water heating device or a dielectric heating device is used as the heating device 16.

The image forming apparatus 100 according to the present embodiment includes the drying devices 18 to heat and dry the recording medium 2 and the ink on the recording medium 2. The drying devices 18 of the present example illustrated in FIG. 3 is disposed at a position facing the conveying member 12. In a case in which the ink on the recording medium 2 is heated, the drying devices 18 is disposed downstream from the image forming device 10 in the conveyance direction of the recording medium 2.

The drying devices 18 is selected accordingly. For example, an infrared heater or a hot air generator is used as the drying devices 18. In the example illustrated in FIG. 1, a hot air generator is used as the drying devices 18. The arrangement and number of the drying devices 18 are not particularly limited and are changed accordingly.

In a case in which an infrared heater is used as the drying devices 18, the surface temperature of the heater is preferably 500° C. or higher. In a known image forming apparatus including an image forming device and a drying device, a recording medium and ink on the recording medium are dried better when the drying temperature is higher. On the other hand, when the drying temperature is relatively high, if the adhesion between the recording medium and the conveying member is not obtained, the recording medium is damaged.

On the other hand, since the adhesion between the recording medium and the conveying member is highly enhanced as described above in the present embodiment, damage to the recording medium is reduced even when the drying temperature is set to a relatively high temperature, for example, the surface temperature of the heater is set to 500° C. or higher. Therefore, according to the present embodiment, even when the drying temperature of the infrared heater is set to a relatively high temperature, damage to the recording medium is reduced and good drying is performed.

In a case in which a hot air generator is used as the drying devices 18, the temperature of the hot air is preferably 100° C. or higher. For the same reason as described above, according to the present embodiment, even when the drying temperature of the hot air generator is relatively high, for example, the temperature of the hot air is 100° C. or higher, damage to the recording medium is reduced, and good drying is performed.

When a hot air generator is used as the drying devices 18, the speed of the hot air is preferably 10 m/sec or more. In a known image forming apparatus using the hot air generator as the drying device, the recording medium and the ink on the recording medium are dried better when the speed of the hot air is higher. On the other hand, when the speed of the hot air is relatively high, the recording medium is damaged unless the adhesion between the recording medium and the conveying member is obtained.

On the other hand, since the adhesion between the recording medium and the conveying member is highly enhanced as described above in the present embodiment, damage to the recording medium is reduced even when the speed of the hot air is relatively high, for example, the speed of hot air is 10 m/sec or more. Therefore, according to the present embodiment, even when the speed of the hot air of the hot air generator is relatively high, damage to the recording medium is reduced, and good drying is performed.

The conveyance speed of the recording medium 2 is changed accordingly, for example, the conveyance speed of the recording medium 2 is preferably 30 m/min or more.

In a known image forming apparatus using a conveying drum, an air knife method may be used to enhance adhesion between the conveying drum and a recording medium. For example, a comparative device uses the air knife method by which the adhesion between the conveying drum and the recording medium is enhanced when the conveyance speed of the recording medium is relatively low. However, when the conveyance speed of the recording medium is relatively high, the good adhesion between the conveying drum and the recording medium may not be obtained by using the air knife method. When the conveying speed of the recording medium is relatively high, for example, 30 m/min or more, air entrainment occurs even if the air knife method is used, and the comparative device fails to enhance the adhesion between the conveying drum and the recording medium.

On the other hand, since the adhesion between the recording medium and the conveying member is highly enhanced as described above in the present embodiment, the entrainment of air is reduced even when the conveyance speed of the recording medium is relatively high, for example, 30 m/min or more. Therefore, good adhesion is maintained even when the conveyance speed of the recording medium is high, and productivity is enhanced.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

What is claimed is:

1. An image forming apparatus comprising:

an image forming device configured to form an image on a continuous recording medium;

a rotatable conveying member having a hollow drum shape, the conveying member being configured to convey the continuous recording medium; and a suction device disposed inside the hollow drum shape of the conveying member, the suction device being configured to suck the continuous recording medium through the conveying member in a fixed region in which the continuous recording medium and the conveying member are in contact with each other.

2. The image forming apparatus according to claim 1, wherein the suction device is configured to:

apply no suction force to the continuous recording medium in a non-contact region in which the continuous recording medium and the conveying member are not in contact with each other, or apply a lower suction force to the continuous recording medium in the non-contact region than in the fixed region.

3. The image forming apparatus according to claim 1, wherein the conveying member includes a porous material.

4. The image forming apparatus according to claim 1, further comprising a heating device disposed inside the hollow drum shape of the conveying member.

5. The image forming apparatus according to claim 1, further comprising a drying device configured to dry the continuous recording medium, wherein the image forming device is disposed upstream from the fixed region in a conveyance direction of the continuous recording medium, and wherein the drying device is disposed downstream from the image forming device in the conveyance direction of the continuous recording medium, at a position facing the conveying member.

6. The image forming apparatus according to claim 5, wherein the drying device is an infrared heater configured to have a surface temperature of 500° C. or higher.

7. The image forming apparatus according to claim 5, wherein the drying device is a hot air generator configured to generate hot air at 100° C. or higher.

8. The image forming apparatus according to claim 5, wherein the drying device is a hot air generator configured to generate hot air at 10 meters per second or more.

9. The image forming apparatus according to claim 1, wherein the conveying member is configured to convey the continuous recording medium at a conveyance speed of 30 meters per minute or more.

* * * * *